US009555535B2

(12) United States Patent
Yun

(10) Patent No.: US 9,555,535 B2
(45) Date of Patent: Jan. 31, 2017

(54) ROTATIONAL FORCE TRANSMITTING DEVICE

(75) Inventor: Moo Young Yun, Seoul (KR)

(73) Assignees: JOONGWOO M-TECH CO., LTD., Danwon-gu, Ansan-si, Gyeonggi-do (KR); Moo Young Yun, Dongjak-gu, Seoul (KR)

( * ) Notice: Subject to any disclaimer, the term of this patent is extended or adjusted under 35 U.S.C. 154(b) by 551 days.

(21) Appl. No.: 14/128,965

(22) PCT Filed: Jun. 20, 2012

(86) PCT No.: PCT/KR2012/004880
§ 371 (c)(1),
(2), (4) Date: Mar. 6, 2014

(87) PCT Pub. No.: WO2012/177050
PCT Pub. Date: Dec. 27, 2012

(65) Prior Publication Data

US 2015/0034350 A1 Feb. 5, 2015

(30) Foreign Application Priority Data

Jun. 21, 2011 (KR) ..... 10-2011-0060123

(51) Int. Cl.
*B25F 5/00* (2006.01)
*B25B 21/00* (2006.01)
*B25B 21/02* (2006.01)

(52) U.S. Cl.
CPC ..... *B25F 5/001* (2013.01); *B25B 21/00* (2013.01); *B25B 21/026* (2013.01); *B25F 5/006* (2013.01)

(58) Field of Classification Search
CPC ..... B25B 21/026; B25C 5/00
USPC ..... 173/93, 93.5, 178, 213, 176, 179, 216; 81/57.11
See application file for complete search history.

(56) References Cited

U.S. PATENT DOCUMENTS 6,178,853 B1 * 1/2001 Huang ..... B25B 21/02 173/93.5
6,209,658 B1 * 4/2001 Yoon ..... B25B 21/00 173/176
6,491,112 B1 * 12/2002 Shin ..... B25B 21/02 173/171
2008/0196555 A1 * 8/2008 Yoon ..... B25B 21/02 81/57.11

* cited by examiner

*Primary Examiner* — Nathaniel Chukwurah
(74) *Attorney, Agent, or Firm* — John K. Park; Park Law Firm

(57) ABSTRACT

A rotational force transmitting device includes: an inertia wheel connected to an output gear; a spindle coupled freely rotatable to the center of the front surface of the inertia wheel; a power transmitting eccentric body extended vertically with respect to the rotary shaft of the spindle; an insert pin inserted into a guide hole, a position restoring spring inserted into the guide hole, for elastically supporting the insert pin in a backward direction; and a balance weight coupled rotatably to the rear surface of the inertia wheel, the balance weight rotating with the centrifugal force generated by the rotation of the inertia wheel to push the insert pin forward to allow the insert pin and the power transmitting eccentric body to be engaged with each other.

20 Claims, 9 Drawing Sheets

-- Prior Art --

ROTATIONAL FORCE TRANSMITTING DEVICE

TECHNICAL FIELD

The present invention relates to a rotational force transmitting device for a power tool such as an impact wrench using the rotational force of a driving motor of the power tool, and more particularly, to a rotational force transmitting device that is capable of effectively transmitting the rotational force of a driving motor through a centrifugal force and a friction force and at the same time minimizing the vibration and shock generated during working.

BACKGROUND ART

FIG. 1 is an exploded perspective view showing a conventional centrifugal clutch power transmission mechanism, which is disclosed in Korean Utility Model Registration No. 0237307 (entitled "electrical screw driving tool"), and an operation principle of the conventional centrifugal clutch power transmission mechanism will be described below.

If a motor does not operate or rotates at a low speed, a lever 17 is pushed to the right side in the drawing through the operation of a spring 8, and an elevating rod 16 connected with the lever 17 through a cam 18 is moved down and escaped from a concave groove 23 of a wing 20. In this state, a spindle 7 is coupled freely rotatable to an inertia wheel 5, and therefore, even though the inertia wheel 5 rotates, the spindle 7 does not rotate. If the rotational speed of the motor reaches a given speed or more, the centrifugal force applied to a starter 10 mounted on the inertia wheel 5 exceeds the elastic force of the spring 8, and accordingly, the starter 10 is moved outward to pull the lever 17, so that the elevating rod 16 is moved up by the operation of the cam 18 and engaged with the concave groove of the wing 20 on the top end periphery thereof, thus hitting and rotating the spindle 7. If substantially large resistance occurs during the rotation to cause the rotational speed of the motor to be decreased, the centrifugal force applied to the starter 10 is not sufficient to allow the starter 10 and the lever 17 to be returned to their original position by the operation of the spring 8, and thus, the elevating rod 16 is moved down by the operation of the cam 18 and escaped from the concave groove 23, thus stopping the rotation of the spindle 7. If the rotational speed of the motor reaches the regulation speed again, the above-mentioned process is carried out again to generate torques needed for mounting/demounting bolts or nuts.

The conventional power transmitting mechanism using the centrifugal force does not immediately transmit the rotational force of the motor to the spindle 7 during the initial operation due to the gaps among the starter 10, the lever 17, the cam 18, and the elevating rod 16, and the elevating rod 16 collides against the concave grove 23 of the wing 20 during the upward movement and thus moved down. After that, the elevating rod 16 is moved up again by the operations of the starter 10, the lever 17, and the cam 18. The downward and upward movements are repeatedly carried out (which is called "chattering"), thus decreasing the transmission efficiency of the rotational force.

Furthermore, the starter 10, the lever 17, the cam 18, and the elevating rod 16 are connected to one another through complicated articulated structures, thus increasing the manufacturing cost and decreasing the durability of the product.

Moreover, separate shock absorbing means is not suggested so that the shock and vibration generated during the working are totally transmitted to a user.

DISCLOSURE

Technical Problem

Accordingly, the present invention has been made in view of the above-mentioned problems occurring in the prior art, and it is an object of the present invention to provide a rotational force transmitting device that is newly configured to effectively transmit the rotational force of a driving motor.

It is another object of the present invention to provide a rotational force transmitting device that is simplified in configuration to reduce the manufacturing cost and improve the durability and reliability.

It is still another object of the present invention to provide a rotational force transmitting device that is newly configured to minimize the shock and vibration generated during working to improve the workability.

Technical Solution

To accomplish the above-mentioned objects, according to the present invention, there is provided a rotational force transmitting device including: an inertia wheel 100 connected to an output gear 22 rotating engagedly with a driving motor 11 and rotating by receiving the rotational force of the driving motor 11; a spindle 200 coupled freely rotatable to the center of the front surface of the inertia wheel 100; a power transmitting eccentric body 210 extended vertically with respect to the rotary shaft of the spindle 200 from one side of the spindle 20; an insert pin 300 inserted into a guide hole 110 formed passed through the front and rear surfaces of the inertia wheel 100; a position restoring spring 320 inserted into the guide hole 110, for elastically supporting the insert pin 300 in a backward direction; and a balance weight 400 coupled rotatably to the rear surface of the inertia wheel 100, for supporting the rear end periphery of the insert pin 300, the balance weight 400 rotating with the centrifugal force generated by the rotation of the inertia wheel 100 to push the insert pin 300 forward to allow the insert pin 300 and the power transmitting eccentric body 210 to be engaged with each other.

BEST MODE FOR INVENTION

Figure 1:
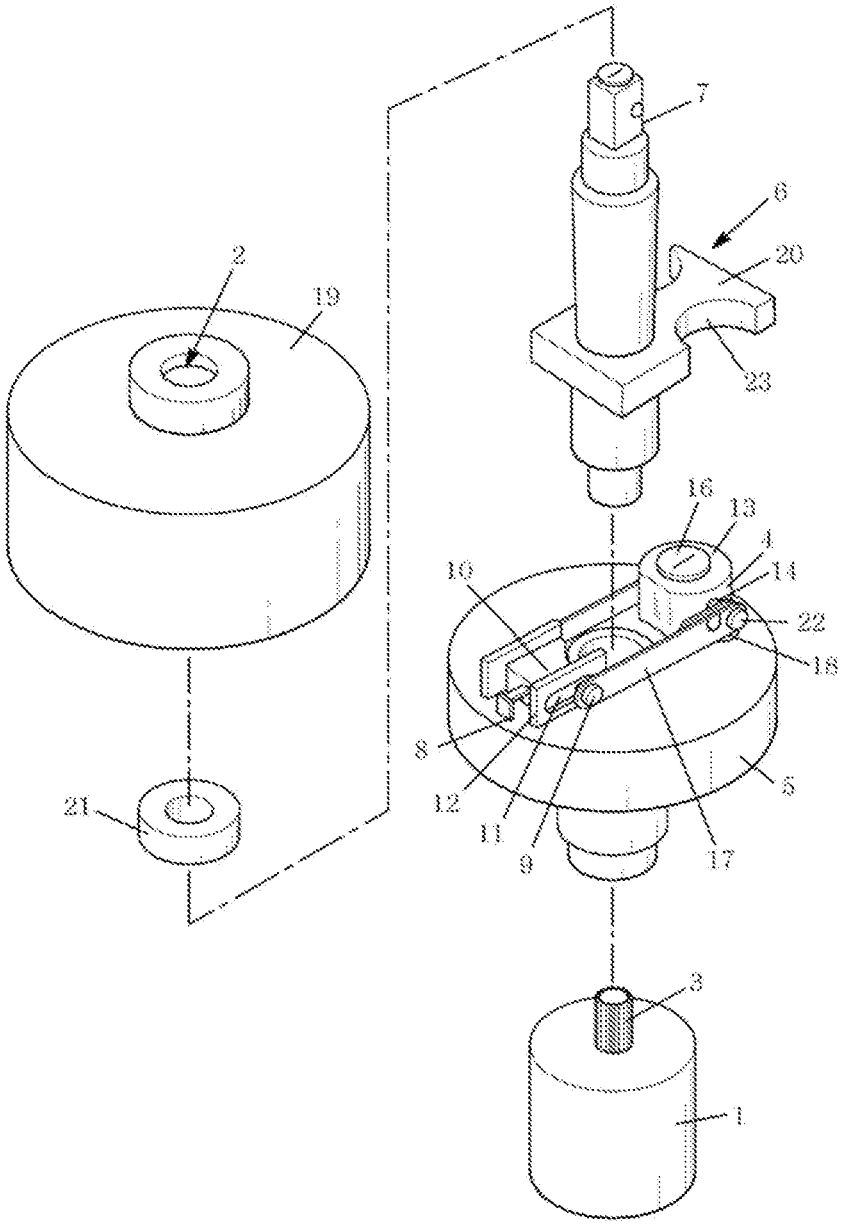
FIG. 1 is an exploded perspective view showing a conventional centrifugal clutch power transmission mechanism.

Hereinafter, an explanation on a rotational force transmitting device according to a first embodiment of the present invention will be in detail given with reference to the attached drawings.

An inertia wheel 100 is connected to an output gear 22 rotating engagedly with a driving motor 11 and rotates by receiving the rotational force of the driving motor 11.

A spindle 200 is coupled freely rotatable to the center of the front surface of the inertia wheel 100, and an insert pin 300 is inserted into a guide hole 110 formed passed through the front and rear surfaces of the inertia wheel 100.

Figure 2:
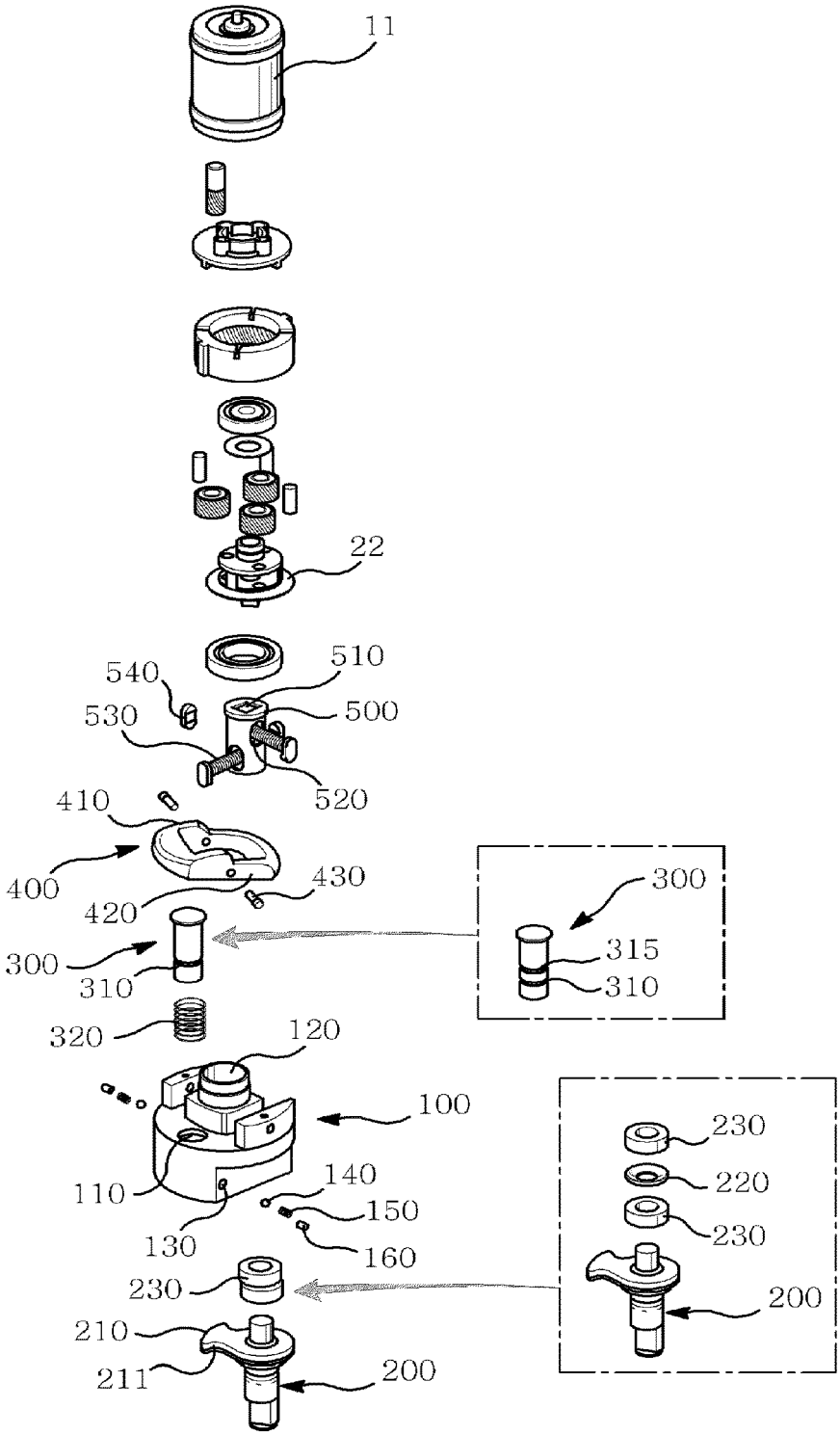
FIG. 2 is an exploded perspective view showing a rotational force transmitting device according to a first embodiment of the present invention.

As shown in FIG. 2, bearings 230 are located between the spindle 200 and the inertia wheel 100 so as to rotate the spindle 200 more gently, and further, a circular plate spring 220 is located between the bearings 230 so as to absorb the shock generated between the bearings 230. The circular plate spring 220 absorbs the vibration occurring in forward and backward directions and decreases chattering.

A position restoring spring 320 is inserted into the guide hole 110, together with the insert pin 300, and serves to elastically support the insert pin 300 in a backward direction.

The spindle 200 has a power transmitting eccentric body 210 extended vertically with respect to the rotary shaft thereof from one side thereof, and as shown in FIG. 2, the power transmitting eccentric body 210 has a concave groove 211 engaged with the insert pin 300.

The balance weight 400 is coupled to the rear surface of the inertia wheel 100 in such a manner as to be rotatable in forward and backward directions, while supporting the rear end periphery of the insert pin 300.

The balance weight 400 rotates with the centrifugal force generated by the rotation of the inertia wheel 100 to push the insert pin 300 forward to allow the insert pin 300 and the power transmitting eccentric body 210 to be engaged with each other.

Figure 3:
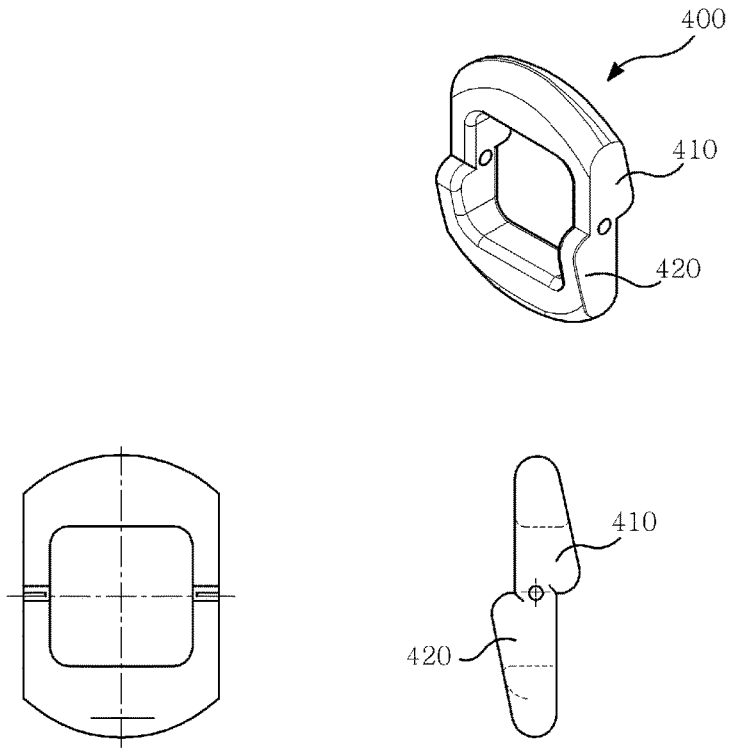
FIG. 3 shows a detailed configuration of a balance weight of the rotational force transmitting device according to the present invention.
Figure 5:
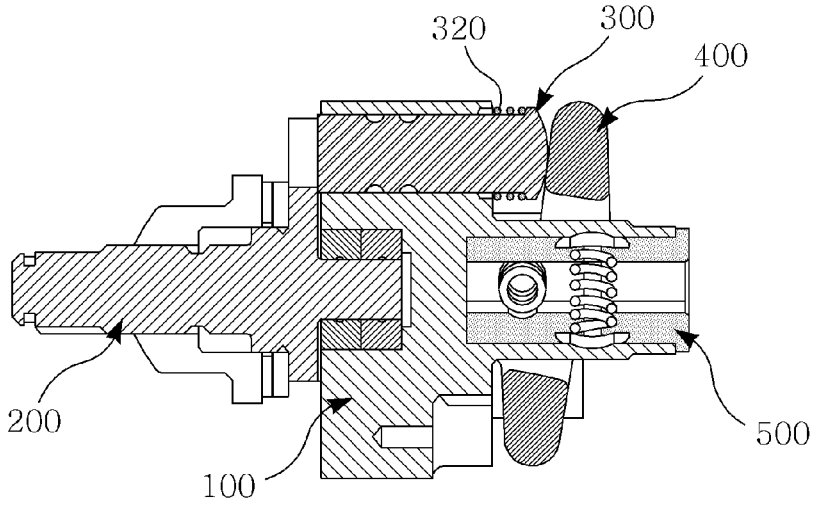
FIG. 5 is a sectional view showing the rotational force transmitting device according to the present invention, wherein a front weight portion and a rear weight portion of the balance weight are protruded in the same shape as each other in the opposite directions to each other.
Figure 6:
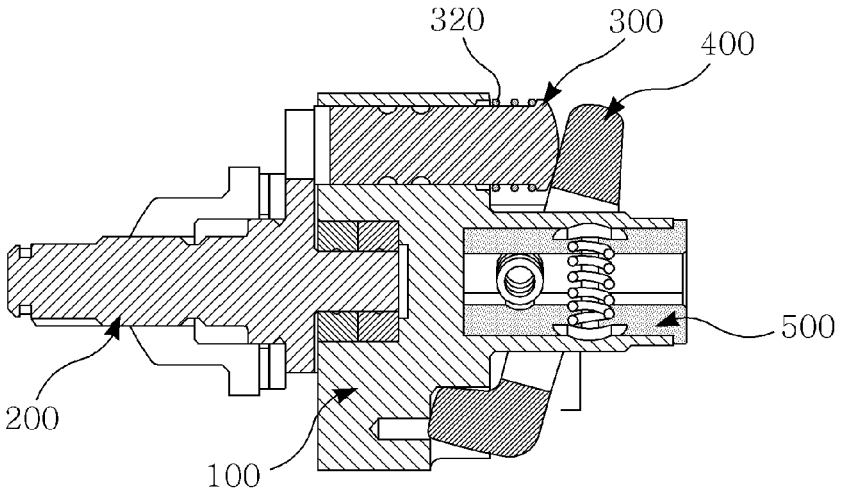
FIG. 6 is a sectional view showing the rotational force transmitting device according to the first embodiment of the present invention, wherein the section of the balance weight is formed asymmetrically to a shape of an "L".
Figure 7:
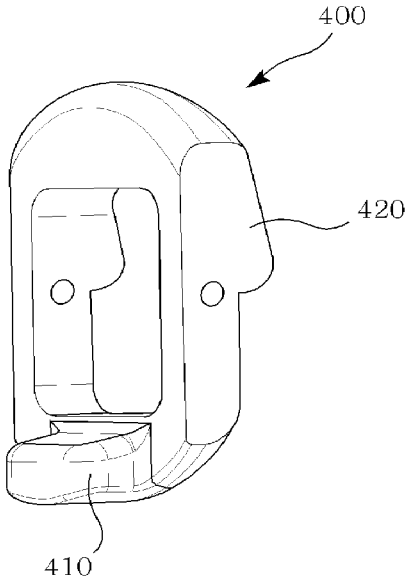
FIG. 7 is a perspective view showing the balance weight adopted in FIG. 6.

As shown in FIGS. 2 and 3, the balance weight 400 is punched at the center portion thereof and has a general shape of "□" or "○". Even though not shown in the drawings, the balance weight 400 may have a shape of "∩". The balance weight 400 rotates with the centrifugal force generated by the rotation of the inertia wheel 100 to push the insert pin 300 forward, and as shown in FIGS. 2 and 3, the balance weight 400 has a rear weight portion 410 formed protruded backward on one side supporting the rear end periphery of the insert pin 300 around a balance pin 430 as a rotary shaft thereof and a front weight portion 420 formed protruded forward on the other side thereof. Through the formation of the rear weight portion 410 and the front weight portion 420, the center line of the balance weight 400 forming the center of the weight is inclined, and if the centrifugal force is applied to the balance weight 400, the center line of the balance weight 400 rotates in the direction perpendicular to the direction of the rotary shaft, so that the rear end periphery of the insert pin 300 is pushed forward by means of one side of the balance weight 400. As shown in FIG. 3 or FIG. 5, the front weight portion 420 and the rear weight portion 410 have the same sizes and shapes as each other in such a manner as to be protruded to the opposite directions to each other. On the other hand, as shown in FIG. 6 or FIG. 7, the front weight portion 420 and the rear weight portion 410 may be protruded in different shapes from each other.

If the force of the balance weight 400 pushing the insert pin 300 forward exceeds the elastic force of the position restoring spring 320, the insert pin 300 becomes protruded and engaged with the concave groove 211 of the power transmitting eccentric body 210, so that the spindle 200 rotates together with the inertia wheel 100.

In this process, if large resistance is applied to the spindle 200, the rotational speed of the inertia wheel 100 is decreased together with the spindle 200, and accordingly, the centrifugal force being applied to the balance weight 400 is decreased, so that if the centrifugal force does not exceed the elastic force of the position restoring spring 320, the insert pin 300 is returned to its original position by means of the elastic force of the position restoring spring 320, and the rotation of the spindle 200 stops.

That is, the forward and backward movements of the insert pin 300 are determined in accordance with the sizes of the centrifugal force applied to the balance weight 400 and the elastic force of the position restoring spring 320, and in some cases, the time points of the movements of the insert pin 300 can be more accurately controlled through tension adjusting means as will be discussed below.

As shown in FIG. 2, a spring hole 130 is formed on the side surface of the inertia wheel 100 in such a manner as to communicate with the guide hole 110, and the spring hole 130 has a screw thread formed on a portion thereof.

A steel ball 140 is inserted into the spring hole 130 in such a manner as to be brought into contact with the outer periphery of the insert pin 300, and as shown in FIG. 2, the insert pin 300 has a first steel ball accommodating groove 310 formed along the outer peripheral surface thereof, so that the steel ball 140 is engaged with the first steel ball accommodating groove 310 of the insert pin 300 when the insert pin 300 pushes backward.

A tension spring 150 is inserted into the spring hole 130 and elastically supports the steel ball 140 against one side portion thereof, thus allowing the steel ball 140 to be brought into close contact with the outer peripheral surface of the insert pin 300.

A tension adjusting pin 160 is fastened to the screw thread formed on the spring hole 130 to support the other side end portion of the tension spring 150. Accordingly, the compressed degrees of the tension spring 150 are varied in accordance with the positions of the tension adjusting pin 160, thus causing the strengths of the steel ball 140 contacted with the outer peripheral surface of the insert pin 300 to be differently generated.

In the case where the above-mentioned tension adjusting means is provided, if the centrifugal force being applied to the balance weight 400 from the rotation of the inertia wheel 100 is larger than the sum of the elastic force of the position restoring spring 320 and the contacting force of the steel ball 140, the insert pin 300 is protruded forward and engaged with the concave groove 211 of the power transmitting eccentric body 210, thus transmitting the rotational force to the spindle 200.

That is, as the tension adjusting pin 160 is fastened or unfastened, the time point transmitting the rotational force to the spindle 200 can be appropriately adjusted.

As shown in FIG. 2, the insert pin 300 further has a second steel ball accommodating groove 315 formed along the outer peripheral surface thereof.

In this case, the steel ball 140 is engaged with the first steel ball accommodating groove 310 of the insert pin 300 when the insert pin 300 pushes backward, and if the insert pin 300 pushes forward by means of the centrifugal force applied to the balance weight 400 (that is, in the state where the insert pin 300 is engaged with the concave groove 211 of the power transmitting eccentric body 210 to transmit the rotational force to the spindle 200), the steel ball 140 is engaged with the second steel ball accommodating groove 315.

That is, if the centrifugal force is less than a given size, the first steel ball accommodating groove 310 into which the steel ball 140 is accommodated holds the insert pin 300 to prevent the insert pin 300 from pushing forward, but if the centrifugal force is more than the given size, the first steel ball accommodating groove 310 allows the insert pin 300 to immediately push forward. To the contrary, if a centrifugal force is more than the given size when the insert pin 300 is returned to its original position by means of the position restoring spring 320, the second steel ball accommodating groove 315 holds the insert pin 300 to prevent the insert pin 300 from being returned backward, and contrarily, if the centrifugal force is less than the given size, the second steel ball accommodating groove 315 allows the insert pin 300 to be immediately returned backward. As a result, the rapid and immediate movements of the insert pin 300 prevent the occurrence of chattering.

As shown in FIG. 2, the shock absorbing cap 500 takes a generally cylindrical shape and has an output gear coupling groove 510 formed on the rear end surface thereof in such a manner as to be coupled to the rotary shaft of the output gear 22.

That is, the shock absorbing cap 500, which has the incised groove portion corresponding to the square shape formed on the end portion of the rotary shaft of the output gear 22 in such a manner as to be coupled to the output gear 22, receives the rotational force of the driving motor 11 through the output gear 22 and rotates together with the output gear 22.

As shown in FIG. 2, a reduction gear part having a plurality of gears with appropriate gear ratios is disposed between the output gear 22 and the driving motor 11.

The shock absorbing cap 500 has spring accommodating holes 520 formed passed through the outer peripheral surface thereof in such a manner as to face each other. Of course, one spring accommodating hole 520 may be formed, but as shown in FIG. 2, desirably, the two spring accommodating holes 520 are formed spaced apart from each other in such a manner as to be perpendicular to each other.

In some cases, of course, two or more spring accommodating holes may be formed to maintain a given angle with one another.

Shock absorbing cap springs 530 and friction pads 540 are mounted into the spring accommodating holes 520.

The shock absorbing cap springs 530 are mounted into the spring accommodating holes 520, and they are formed of coil type springs having a given size providing appropriate elastic forces.

As shown in FIG. 2, the friction pads 540 are coupled to the shock absorbing cap springs 530 mounted into the spring accommodating holes 520. The friction pads 540 are brought into close contact with the inner peripheral surface of a shock absorbing cap coupling groove 120 of the inertia wheel 100 by means of the elastic forces of the shock absorbing cap springs 530 in the state where the shock absorbing cap 500 is inserted into the shock absorbing cap coupling groove 120 of the inertia wheel 100, thus transmitting the rotational force of the shock absorbing cap 500 to the inertia wheel 100.

The friction pads 540 are made of various materials, desirably, engineering plastics, rather than urethane rubber.

The engineering plastics have higher strength, elasticity, shock resistance, abrasion resistance, heat resistance, chemical resistance, and fatigue resistance than the existing plastics, and further, they have an excellent electrical insulation property. Also, the engineering plastics mean high functional resins having high molecular structures and are widely used as engineering materials or structural materials. Various performance and features of the engineering plastics are changed in accordance with the chemical structures, but the engineering plastics have been classified into polyamide, polyester, polycarbonate, polybutylenetrephthalate (PBT), and polyphenylene oxide (PPO). Conventional plastics are formed of tens to hundreds of low molecular materials, but the engineering plastics are formed of hundreds of thousands to millions of polymer materials, so that they can obtain appropriate strength, elasticity, hardness, tension, density and molding as a structural material.

The shapes corresponding to the friction pads 540 are machined to a given depth on the outer peripheral surface of the shock absorbing cap 500 into which the spring accommodating holes 520 are formed, for stably accommodating the friction pads 540 coupled to both side end portions of the shock absorbing cap springs 530 thereinto, while preventing the friction pads 540 from being escaped to the outside.

Figure 4:
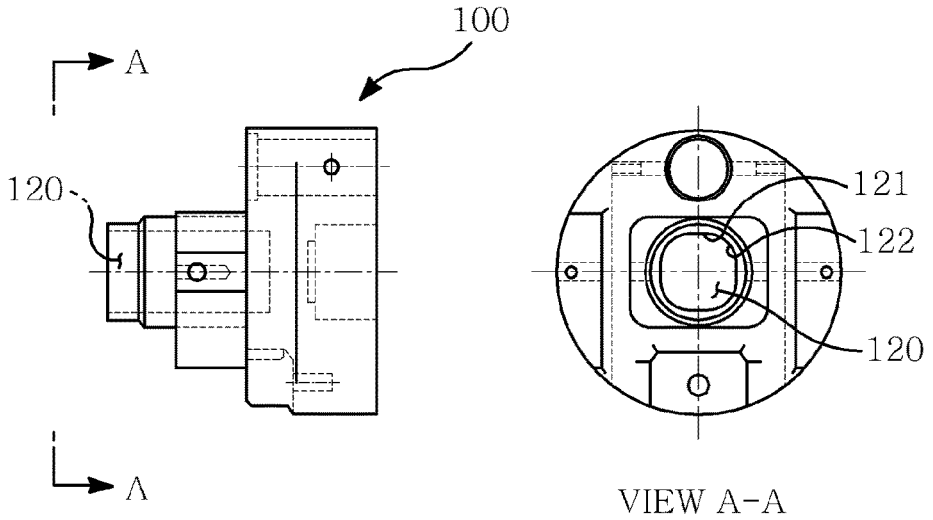
FIG. 4 is a sectional view showing a shock absorbing cap coupling groove formed in an inertia wheel in the rotational force transmitting device according to the present invention.

As shown in FIG. 4, the inertia wheel 100 has the shock absorbing cap coupling groove 120 formed on the rear end surface thereof to insert the front portion of the shock absorbing cap 500 thereinto.

The shock absorbing cap coupling groove 120 to which the shock absorbing cap 500 is coupled is not simple round, but as shown in FIG. 4, it has a square shape rounded at corners thereof, so that a linear surface 121 and a curved surface 122 are repeatedly connected to each other.

When the linear surface 121 and the curved surface 122 are repeatedly formed, the distance between the center of the shock absorbing cap 500 and the curved surface 122 becomes longer than the distance between the center of the shock absorbing cap 500 and the linear surface 121, and accordingly, the friction pads 540 are assembled contacted with the curved surfaces 122, so that the assembled states can be still maintained unless an external force is applied thereto.

Hereinafter, an explanation on the operation of the rotational force transmitting device according to the first embodiment of the present invention will be given.

In case of bolt fastening, for example, if the driving motor 11 rotates, the rotational force of the driving motor 11 is transmitted to the shock absorbing cap 500 through the rotary shaft of the output gear 22. If bolt fastening load is not large, the rotational force of the shock absorbing cap 500 is almost transmitted to the inertia wheel 100 through the friction action of the friction pads 540, thus rotating the inertia wheel 100. Accordingly, the balance weight 400 rotates by means of the centrifugal force generated through the rotation of the inertia wheel 100 and pushes the insert pin 300 forward, so that the front end periphery of the insert pin 300 is engaged with the concave grove 211 of the power transmitting eccentric body 210 to rotate the spindle 200, thus conducting the bolt fastening. If the time point at which the bolt fastening is completed is reached or bolt fastening load is increased by other problems, the increased load is transmitted to the inertia wheel 100 through the power transmitting eccentric body 210 of the spindle 200 and the insert pin 300, and if the external load applied to the inertia wheel 100 during the rotation of the shock absorbing cap 500 is larger than the friction forces of the friction pads 540 and the elastic forces of the shock absorbing cap springs 530, the shock absorbing cap springs 530 are compressed to allow the friction pads 540 contacted with the curved surfaces 122 of the shock absorbing cap coupling groove 120 to be seated on their next curved surfaces 122 over the linear surfaces 121, thus hitting the inertia wheel 100. The hitting force is applied as a force needed for bolt fastening. The hitting process is carried out as the compressed shock absorbing cap springs 530 are expanded again when they are over the linear surfaces 121, and an amount of shock generated during the hitting process is substantially reduced, so that the bolt fastening can be conducted more conveniently by a user.

The formation of the balance weight 400 and the insert pin 300 enables the rotational force of the inertia wheel 100 to be transmitted to the spindle 200 or cut off in accordance with the sizes of the centrifugal force generated in proportion to the rotational speed of the inertia wheel 100, separately from the operation of the shock absorbing cap 500.

That is, the external load is increased to make the friction pads 540 slide over the linear surfaces 121 and the curved surfaces 122, and thus, if the rotational speed of the inertia wheel 100 is decreased or if the rotation of the inertia wheel 100 stops, the centrifugal force being applied to the balance weight 400 is reduced to allow the power transmitting eccentric body 210 and the insert pin 300 to be released from their engaged state by means of the operation of the position restoring spring 320, so that the external load is not transmitted further to the inertia wheel 100 through the spindle 200. If the load is not applied any more to the inertia wheel 100, the rotational force of the shock absorbing cap 500 is almost transmitted to the inertia wheel 100 through the friction pads 540, and the inertia wheel 100 rotates again together with the shock absorbing cap 500 to generate the centrifugal force therefrom. Accordingly, the balance weight 400 rotates to push the insert pin 300 forward, and the front end periphery of the insert pin 300 is engaged with the concave groove 211 of the power transmitting eccentric body 210 to hit the power transmitting eccentric body 210, thus applying a force needed for bolt fastening.

That is, the hitting force needed for bolt fastening or unfastening can be applied efficiently through the operations of the shock absorbing cap 500 and the insert pin 300, and at the same time, the vibration or shock transmitted to the user can be substantially reduced.

Figure 8:
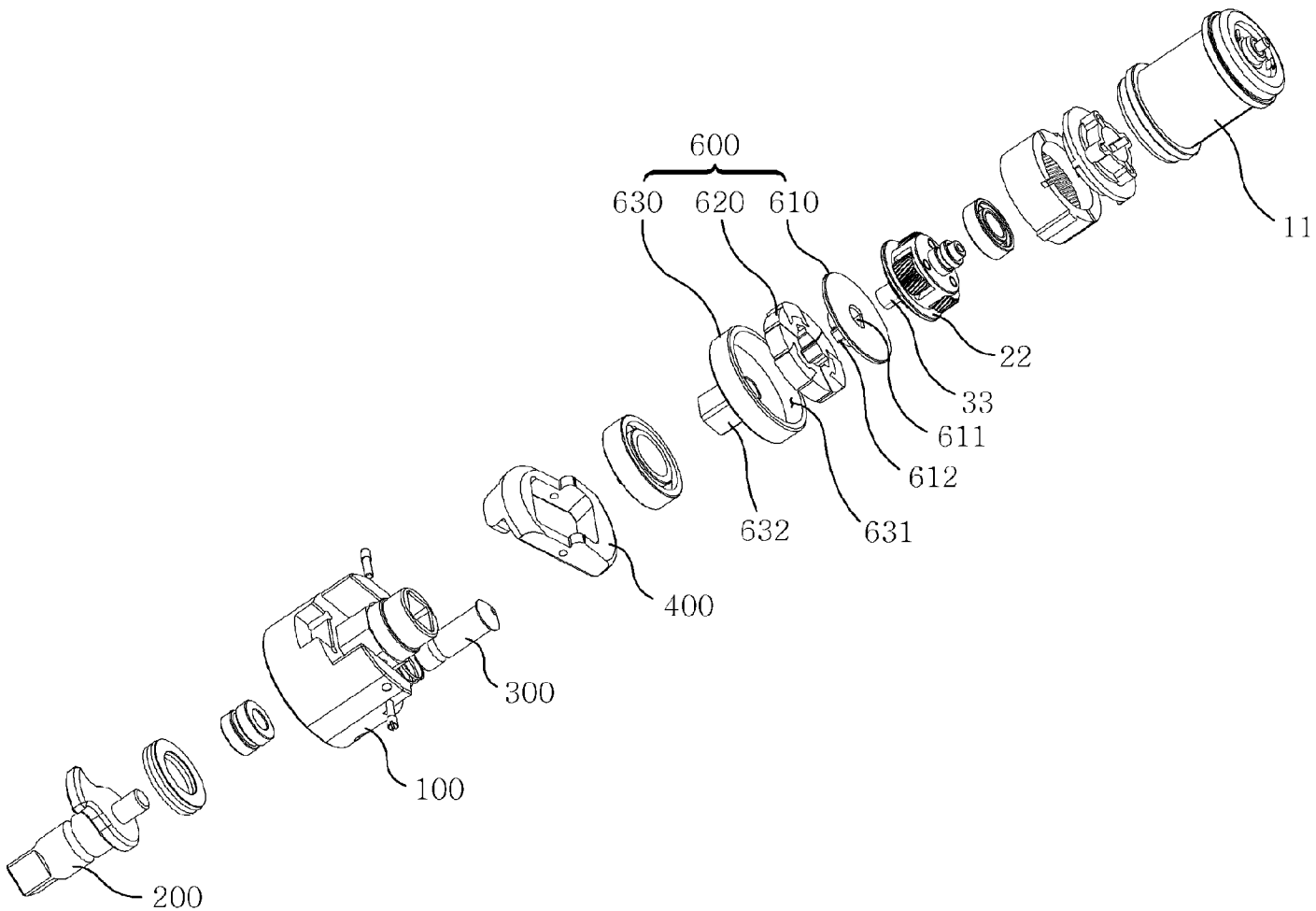
FIG. 8 is an exploded perspective view showing a rotational force transmitting device according to a second embodiment of the present invention, wherein a shock absorbing cap is replaced with a rubber pad type shock absorber.
Figure 9:
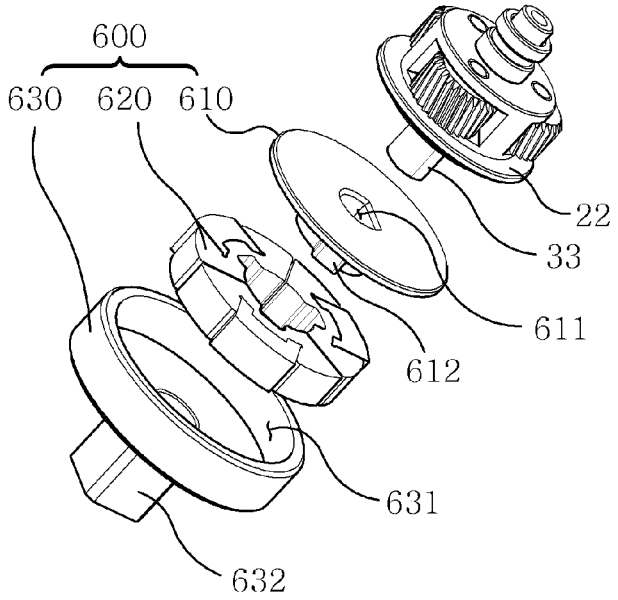
FIG. 9 is an exploded perspective view showing the rubber pad type shock absorber.

FIGS. 8 and 9 show a rotational force transmitting device according to a second embodiment of the present invention, wherein the shock absorbing cap 500 is replaced with a rubber pad type shock absorber 600.

As shown in FIG. 9, the rubber pad type shock absorber 600 includes a rotary plate 610, a shock absorbing rubber pad 620, and a shock absorbing drum 630.

The rotary plate 610 has an output gear coupling groove 611 formed on the rear surface thereof in such a manner as to be engaged rotatably with the output gear 22. That is, one side of the outer peripheral surface of an output gear shaft 33 has a cut sectional shape, and the output gear coupling groove 611 has the sectional shape corresponding to the cut sectional shape of the output gear shaft 33, so that the output gear shaft 33 does not idle when inserted into the output gear coupling groove 611, thus transmitting the rotational force of the output gear shaft 33 to the rotary plate 610.

The shock absorbing rubber pad 620 is disposed inside a rubber pad accommodating portion 631 of the shock absorbing drum 630 in such a manner as to be engaged rotatably with a rotational force coupling protrusion 612 protruded from the front surface of the rotary plate 610 and open outwardly by means of the centrifugal force. The shock absorbing rubber pad 620 is formed of three pieces and disposed at the interior of the rubber pad accommodating portion 631 in such a manner as to rotate according to the rotation of the rotary plate 610. If the rotational speed of the shock absorbing rubber pad 620 is increased, the centrifugal force is increased in proportion to the increased rotational speed to make the shock absorbing rubber pad 620 gradually open and brought into close contact with the inner peripheral surface of the rubber pad accommodating portion 631. Through the close contact of the shock absorbing rubber pad 620 with the rubber pad accommodating portion 631, the rotational force of the rotary plate 610 is transmitted to the shock absorbing drum 630. As shown in FIG. 8, the rotational force transmitted to the shock absorbing drum 630 is transmitted to the inertia wheel 100 through a first inertia wheel coupling protrusion 632 protruded from the front surface of the shock absorbing drum 630.

An operation of the rotational force transmitting device according to the second embodiment of the present invention is carried out in the same manner as that according to the first embodiment of the present invention.

In case of bolt fastening, for example, if the driving motor 11 rotates, the rotational force of the driving motor 11 is transmitted to the rubber pad type shock absorber 600 through the output gear shaft 33 of the output gear 22. If the bolt fastening load is not large, most of the rotational force of the rubber pad type shock absorber 600 is transmitted to the inertia wheel 100 through the friction action between the shock absorbing rubber pad 620 and the rubber pad accommodating portion 631 of the shock absorbing drum 630, thus rotating the inertia wheel 100. Accordingly, the operations of the balance weight 400 and the insert pin 300 according to the rotation of the inertia wheel 100 are carried out in the same manner as those in the first embodiment of the present invention as shown in FIGS. 2 to 5, and for the brevity of the description, an explanation of the operations will be avoided.

If the bolt fastening load is increased during the bolt fastening, the external load is transmitted to the inertia wheel 100, and in this case, if the size of the external load is larger than the friction force between the shock absorbing rubber pad 620 and the rubber pad accommodating portion 631 of the shock absorbing drum 630, sliding occurs between the shock absorbing drum 630 and the rotary plate 610 to absorb the shock applied to the user. Further, if such sliding occurs, the rotational speed of the inertia wheel 100 is drastically decreased to release the engaged state between the power transmitting eccentric body 210 and the insert pin 300, so that the external load is not transmitted any more to the inertia wheel 100 through the spindle 200. If the load is not applied any more to the inertia wheel 100, the rotational force of the rubber pad type shock absorber 600 is almost transmitted to the inertia wheel 100, and the inertia wheel 100 rotates again to generate the centrifugal force. Accordingly, the balance weight 400 rotates to push the insert pin 300 forward, and the front end periphery of the insert pin 300 is engaged with the concave groove 211 of the power transmitting eccentric body 210 to hit the power transmitting eccentric body 210, thus applying a force needed for bolt fastening.

Figure 10:
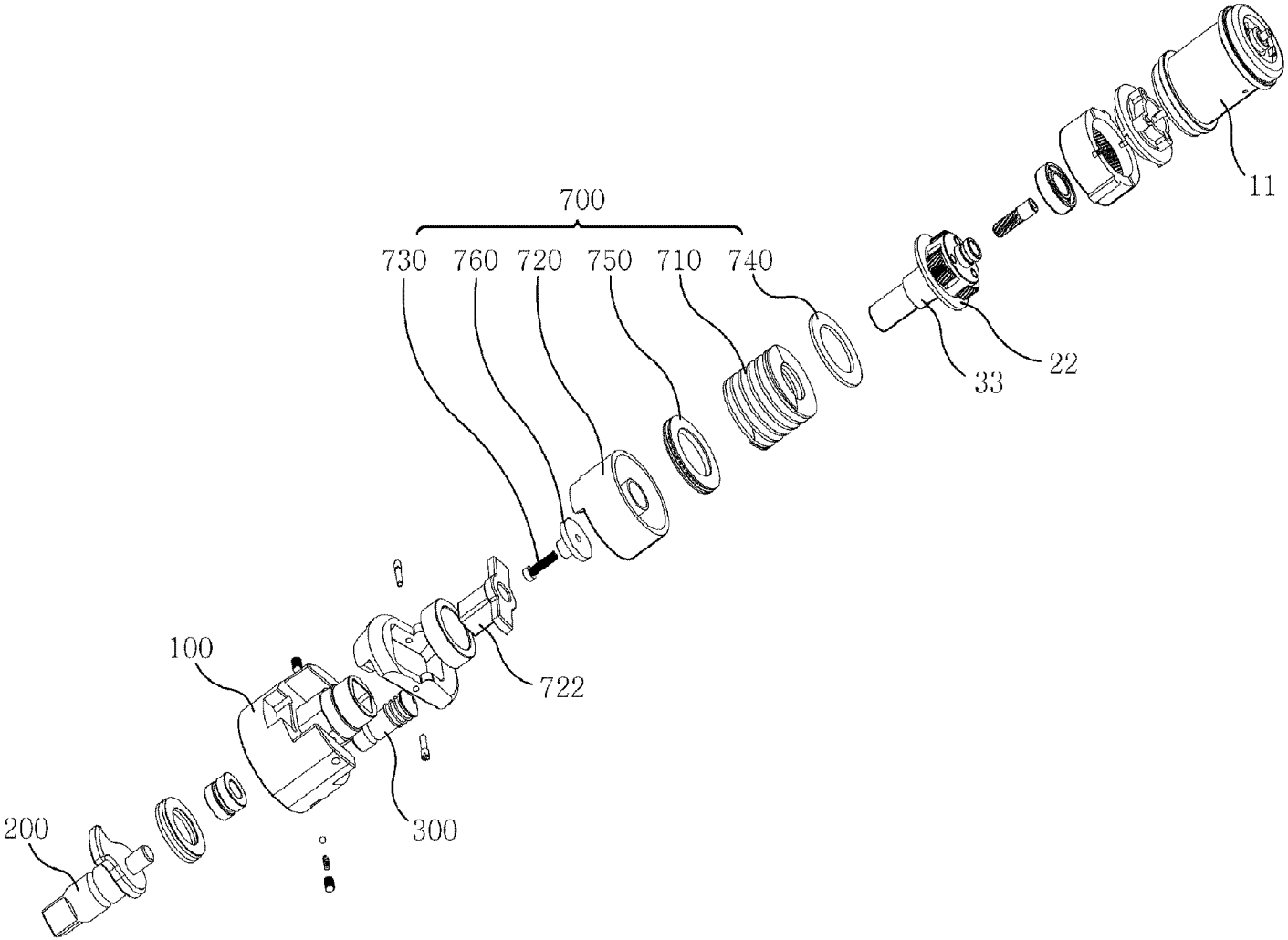
FIG. 10 is an exploded perspective view showing a rotational force transmitting device according to a third embodiment of the present invention, wherein a shock absorbing cap is replaced with a spring type shock absorber.
Figure 11:
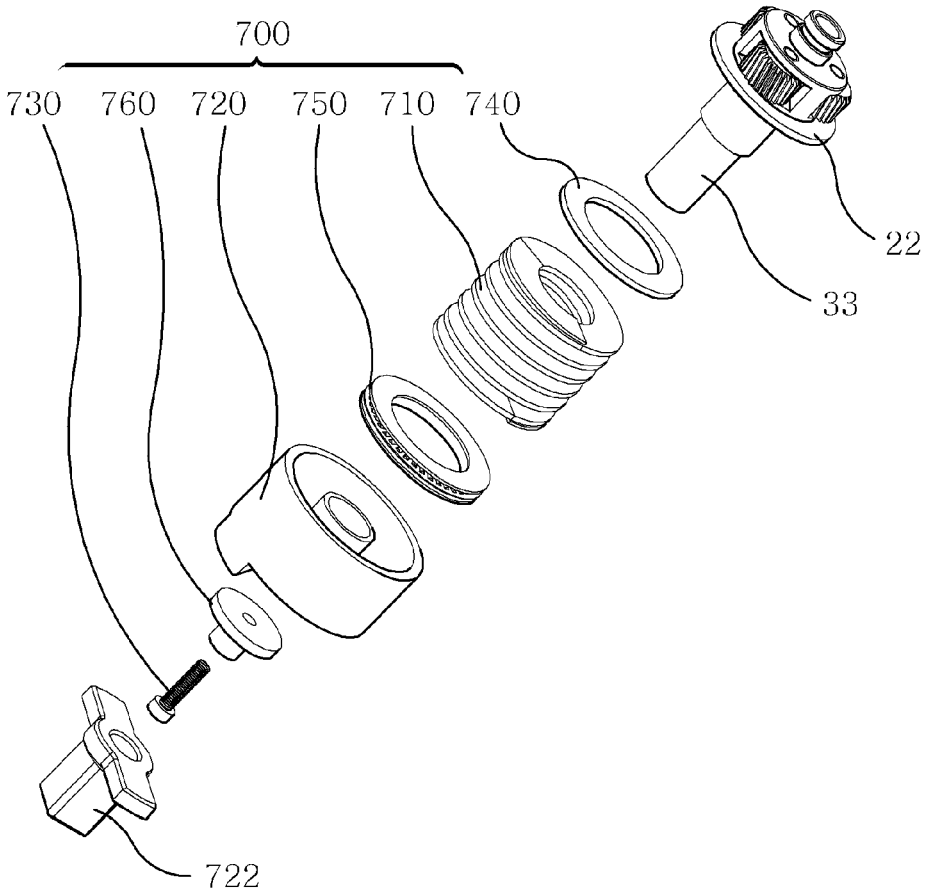
FIG. 11 is an exploded perspective view showing the spring type shock absorber.

FIGS. 10 and 11 show a rotational force transmitting device according to a third embodiment of the present invention, wherein the shock absorbing cap 500 is replaced with a spring type shock absorber 700.

The spring type shock absorber 700 is disposed between the inertia wheel 100 and the output gear 22 and serves to transmit the rotational force of the output gear 22 to the inertia wheel 100 and to absorb the external shock transmitted through the inertia wheel 100. The spring type shock absorber 700 includes a shock absorbing spring 710, a hitting absorbing body 720, shock absorbing rubber 740, a thrust bearing 750, a fixing cap 760 and a fastening bolt 730.

The shock absorbing spring 710 is fitted to the output gear shaft 33 protruded long from the front surface of the output gear 22 and compressed inside the hitting absorbing body 720, thus elastically supporting the hitting absorbing body 720 and the output gear 22 and transmitting the rotational force of the output gear 22 to the hitting absorbing body 720.

A spring accommodating portion 721 is formed on the rear surface of the hitting absorbing body 720, for accommodating the shock absorbing spring 710 thereinto, and a second inertia wheel coupling protrusion 722 is formed on the front surface of the hitting absorbing body 720 in such a manner as to be coupled to the inertia wheel 100.

The shock absorbing rubber 740 is fitted to the output gear shaft 33 and disposed between the shock absorbing spring 710 and the output gear 22.

The thrust bearing 750 is fitted to the output gear shaft 33 and disposed between the inner peripheral surface of the hitting absorbing body 720 and the shock absorbing spring 710.

The fixing cap 760 is mounted into the groove formed on the front surface of the hitting absorbing body 720 and disposed between the fastening bolt 730 and the hitting absorbing body 720.

The fastening bolt 730 is fastened to the front end surface of the output gear shaft 33 passed through the interior of the hitting absorbing body 720 to couple the hitting absorbing body 720 and the output gear 22 with each other.

An operation of the rotational force transmitting device according to the third embodiment of the present invention is carried out in the almost same manner as that according to the first embodiment of the present invention.

In case of bolt fastening, for example, if the driving motor 11 rotates, the rotational force of the driving motor 11 is transmitted to the spring type shock absorber 700 through the output gear shaft 33 of the output gear 22. If the bolt fastening load is not large, the rotational force of the rubber pad type shock absorber 600 is almost transmitted to the hitting absorbing body 720 through the friction action caused by the elastic force of the shock absorbing spring 710, thus rotating the inertia wheel 100. Accordingly, the operations of the balance weight 400 and the insert pin 300 according to the rotation of the inertia wheel 100 are carried out in the same manner as those in the first embodiment of the present invention as shown in FIGS. 2 to 5, and for the brevity of the description, an explanation of the operations will be avoided.

If the bolt fastening load is increased during the bolt fastening, the external load is transmitted to the inertia wheel 100, and in this case, if the size of the external load is larger than the friction force caused by the elasticity of the shock absorbing spring 710 disposed compressed inside the hitting absorbing body 720, sliding occurs between the hitting absorbing body 720 and the output gear 22 to absorb the shock applied to the user. Further, if such sliding occurs, the rotational speed of the inertia wheel 100 is drastically decreased to release the engaged state between the power transmitting eccentric body 210 and the insert pin 300, so that the external load is not transmitted any more to the inertia wheel 100 through the spindle 200. If the load is not applied any more to the inertia wheel 100, the rotational force of the spring type shock absorber 700 is almost transmitted to the inertia wheel 100, and the inertia wheel 100 rotates again to generate the centrifugal force. Accordingly, the balance weight 400 rotates to push the insert pin 300 forward, and the front end periphery of the insert pin 300 is engaged with the concave groove 211 of the power transmitting eccentric body 210 to hit the power transmitting eccentric body 210, thus applying a force needed for bolt fastening.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

INDUSTRIAL APPLICABILITY

According to the present invention, the rotational force transmitting device has the following advantages.

Firstly, the rotational force of the driving motor can be effectively transmitted. That is, no gap is formed between the balance weight and the insert pin, or the formation of the gap is minimized therebetween, so that if the balance weight rotates by means of the centrifugal force, the insert pin immediately pushes forward and is engaged with the concave groove of the power transmitting eccentric body to transmit the rotational force to the spindle, thus effectively transmitting the rotational force to prevent the occurrence of chattering.

Secondly, the structure is simplified to reduce the manufacturing cost and improve the durability and reliability. In conventional practice, the starter, the lever, the cam, and the elevating rod are connected to one another through complicated articulated structures, which increases the manufacturing cost and decreases the durability of the product. According to the present invention, however, a simple structure is provided wherein the insert pin pushes forward just by the rotation of the balance weight, which decreases the manufacturing cost and improves the durability and reliability.

Lastly, the shock and vibration generated during working can be minimized to improve the workability. That is, the shock absorbing cap is provided to absorb the shock and vibration generated during working and at the same time to effectively transmit the rotational force, thus enhancing the working efficiency.

The invention claimed is:

1. A rotational force transmitting device comprising:

an inertia wheel 100 connected to an output gear 22 rotating engagedly with a driving motor 11 and rotating by receiving the rotational force of the driving motor 11;

a spindle 200 coupled freely rotatable to the center of the front surface of the inertia wheel 100;

a power transmitting eccentric body 210 extended vertically with respect to the rotary shaft of the spindle 200 from one side of the spindle 20;

an insert pin 300 inserted into a guide hole 110 formed passed through the front and rear surfaces of the inertia wheel 100;

a position restoring spring 320 inserted into the guide hole 110, for elastically supporting the insert in 300 in a backward direction; and a balance weight 400 coupled rotatable to the rear surface of the inertia wheel 100, for supporting the rear end periphery of the insert pin 300, the balance weight 400 rotating with the centrifugal force generated by the rotation of the inertia wheel 100 to push the insert pin 300 forward to allow the insert pin 300 and the power transmitting eccentric body 210 to be engaged with each other, wherein the balance weight 400 is punched at the center portion thereof and has a general shape of "□", "○", or "∩", the balance weight 400 having a rear weight portion 410 formed protruded backward on one side supporting the rear end periphery of the insert pin 300 around a balance pin 430 as a rotary shaft thereof and a front weight portion 420 formed protruded forward on the other side thereof.

2. The rotational force transmitting device according to claim 1, wherein the insert pin 300 has a first steel ball accommodating groove 310 formed along the outer peripheral surface thereof, and the inertia wheel 100 comprises: a spring hole 130 formed on the side surface thereof in such a manner as to communicate with the guide hole 110, the spring hole 130 having a screw thread formed on a portion thereof; a steel ball 140 inserted into the spring hole 130 in such a manner as to be brought into contact with the outer periphery of the insert pin 300; a tension spring 150 inserted into the spring hole 130, for elastically supporting the steel ball 140 against one side portion thereof; and a tension adjusting pin 160 fastened to the screw thread formed on the spring hole 130, for supporting the other side end portion of the tension spring 150.

3. The rotational force transmitting device according to claim 1, wherein the insert pin 300 has a first steel ball accommodating groove 310 and a second steel ball accommodating groove 310 formed spaced apart from each other by a given distance along the outer peripheral surface thereof, and the inertia wheel 100 comprises: a spring hole 130 formed on the side surface thereof in such a manner as to communicate with the guide hole 110, the spring hole 130 having a screw thread formed on a portion thereof; a steel ball 140 inserted into the spring hole 130 in such a manner as to be brought into contact with the outer periphery of the insert pin 300; a tension spring 150 inserted into the spring hole 130, for elastically supporting the steel ball 140 against one side portion thereof; and a tension adjusting pin 160 fastened to the screw thread formed on the spring hole 130, for supporting the other side end portion of the tension spring 150, whereby the steel ball 140 is engaged with the first steel ball accommodating groove 310 of the insert pin 300 when the insert pin 300 pushes backward, and if the insert pin 300 pushes forward by means of the centrifugal force of the balance weight 400 to allow the insert pin 300 to be engaged with the concave groove 211 of the power transmitting eccentric body 210, the steel ball 140 is engaged with the second steel ball accommodating groove 315.

4. The rotational force transmitting device according to claim 1, further comprising:

bearings 230 fitted to the spindle 200 coupled to the center of the front surface of the inertia wheel 100; and a circular plate spring 220 fitted to the spindle 200 together with the bearings 230, for absorbing the vibration generated forward and backward.

5. A rotational force transmitting device comprising:

an inertia wheel 100 connected to an output gear 22 rotating engagedly with a driving motor 11 and rotating by receiving the rotational force of the driving motor 11;

a spindle 200 coupled freely rotatable to the center of the front surface of the inertia wheel 100;

a power transmitting eccentric body 210 extended vertically with respect to the rotary shaft of the spindle 200 from one side of the spindle 20;

an insert pin 300 inserted into a guide hole 110 formed passed through the front and rear surfaces of the inertia wheel 100;

a position restoring spring 320 inserted into the guide hole 110, for elastically supporting the insert pin 300 in a backward direction; and a balance weight 400 coupled rotatably to the rear surface of the inertia wheel 100, for supporting the rear end periphery of the insert pin 300, the balance weight 400 rotating with the centrifugal force generated by the rotation of the inertia wheel 100 to push the insert pin 300 forward to allow the insert pin 300 and the power transmitting eccentric body 210 to be engaged with each other, further comprising a shock absorbing cap 500 taking a generally cylindrical shape in such a manner as to be inserted into a shock absorbing cap coupling groove 120 formed on the rear surface of the inertia wheel 100, the shock absorbing cap 500 comprising:

an output gear coupling groove 510 formed on the rear end surface thereof in such a manner as to be coupled to the rotary shaft of the output gear 22;

spring accommodating holes 520 formed passed through the outer peripheral surface thereof in such a manner as to face each other;

shock absorbing cap springs 530 mounted into the spring accommodating holes 520; and friction pads 540 coupled to both side end portions of the shock absorbing cap springs 530 in such a manner as to be brought into close contact with the inner peripheral surface of the shock absorbing cap coupling groove 120 of the inertia wheel 100 by means of the elastic forces of the shock absorbing cap springs 530 in the state where the shock absorbing cap 500 is inserted into the shock absorbing cap coupling groove 120 of the inertia wheel 100.

6. The rotational force transmitting device according to claim 5, wherein the shock absorbing cap 500 has the two spring accommodating holes 520 formed spaced apart from each other in such a manner as to be perpendicular to each other, and the shock absorbing cap springs 530 and the friction pads 540 are mounted into the two spring accommodating holes 520.

7. The rotational force transmitting device according to claim 6, wherein the shock absorbing cap coupling groove 120 of the inertia wheel 100 has a square shape rounded at corners thereof, so that a linear surface 121 and a curved surface 122 are repeatedly connected to each other.

8. The rotational force transmitting device according to claim 6, wherein the insert pin 300 has a first steel ball accommodating groove 310 formed along the outer peripheral surface thereof, and the inertia wheel 100 comprises: a spring hole 130 formed on the side surface thereof in such a manner as to communicate with the guide hole 110, the spring hole 130 having a screw thread formed on a portion thereof; a steel ball 140 inserted into the spring hole 130 in such a manner as to be brought into contact with the outer periphery of the insert pin 300; a tension spring 150 inserted into the spring hole 130, for elastically supporting the steel ball 140 against one side portion thereof; and a tension adjusting pin 160 fastened to the screw thread formed on the spring hole 130, for supporting the other side end portion of the tension spring 150.

9. The rotational force transmitting device according to claim 6, wherein the insert pin 300 has a first steel ball accommodating groove 310 and a second steel ball accommodating groove 310 formed spaced apart from each other by a given distance along the outer peripheral surface thereof, and the inertia wheel 100 comprises: a spring hole 130 formed on the side surface thereof in such a manner as to communicate with the guide hole 110, the spring hole 130 having a screw thread formed on a portion thereof; a steel ball 140 inserted into the spring hole 130 in such a manner as to be brought into contact with the outer periphery of the insert pin 300; a tension spring 150 inserted into the spring hole 130, for elastically supporting the steel ball 140 against one side portion thereof; and a tension adjusting pin 160 fastened to the screw thread formed on the spring hole 130, for supporting the other side end portion of the tension spring 150, whereby the steel ball 140 is engaged with the first steel ball accommodating groove 310 of the insert pin 300 when the insert pin 300 pushes backward, and if the insert pin 300 pushes forward by means of the centrifugal force of the balance weight 400 to allow the insert pin 300 to be engaged with the concave groove 211 of the power transmitting eccentric body 210, the steel ball 140 is engaged with the second steel ball accommodating groove 315.

10. The rotational force transmitting device according to claim 6, further comprising:

bearings 230 fitted to the spindle 200 coupled to the center of the front surface of the inertia wheel 100; and a circular plate spring 220 fitted to the spindle 200 together with the bearings 230, for absorbing the vibration generated forward and backward.

11. The rotational force transmitting device according to claim 5, wherein the shock absorbing cap coupling groove 120 of the inertia wheel 100 has a square shape rounded at corners thereof, so that a linear surface 121 and a curved surface 122 are repeatedly connected to each other.

12. The rotational force transmitting device according to claim 5, wherein the insert pin 300 has a first steel ball accommodating groove 310 formed along the outer peripheral surface thereof, and the inertia wheel 100 comprises: a spring hole 130 formed on the side surface thereof in such a manner as to communicate with the guide hole 110, the spring hole 130 having a screw thread formed on a portion thereof; a steel ball 140 inserted into the spring hole 130 in such a manner as to be brought into contact with the outer periphery of the insert pin 300; a tension spring 150 inserted into the spring hole 130, for elastically supporting the steel ball 140 against one side portion thereof; and a tension adjusting pin 160 fastened to the screw thread formed on the spring hole 130, for supporting the other side end portion of the tension spring 150.

13. The rotational force transmitting device according to claim 5, wherein the insert pin 300 has a first steel ball accommodating groove 310 and a second steel ball accommodating groove 310 formed spaced apart from each other by a given distance along the outer peripheral surface thereof, and the inertia wheel 100 comprises: a spring hole 130 formed on the side surface thereof in such a manner as to communicate with the guide hole 110, the spring hole 130 having a screw thread formed on a portion thereof; a steel ball 140 inserted into the spring hole 130 in such a manner as to be brought into contact with the outer periphery of the insert pin 300; a tension spring 150 inserted into the spring hole 130, for elastically supporting the steel ball 140 against one side portion thereof; and a tension adjusting pin 160 fastened to the screw thread formed on the spring hole 130, for supporting the other side end portion of the tension spring 150, whereby the steel ball 140 is engaged with the first steel ball accommodating groove 310 of the insert pin 300 when the insert pin 300 pushes backward, and if the insert pin 300 pushes forward by means of the centrifugal force of the balance weight 400 to allow the insert pin 300 to be engaged with the concave groove 211 of the power transmitting eccentric body 210, the steel ball 140 is engaged with the second steel ball accommodating groove 315.

14. The rotational force transmitting device according to claim 5, further comprising:

bearings 230 fitted to the spindle 200 coupled to the center of the front surface of the inertia wheel 100; and a circular plate spring 220 fitted to the spindle 200 together with the bearings 230, for absorbing the vibration generated forward and backward.

15. A rotational force transmitting device comprising:

an inertia wheel 100 connected to an output gear 22 rotating engagedly with a driving motor 11 and rotating by receiving the rotational force of the driving motor 11;

a spindle 200 coupled freely rotatable to the center of the front surface of the inertia wheel 100;

a power transmitting eccentric body 210 extended vertically with respect to the rotary shaft of the spindle 200 from one side of the spindle 20;

an insert pin 300 inserted into a guide hole 110 formed passed through the front and rear surfaces of the inertia wheel 100;

a position restoring spring 320 inserted into the guide hole 110, for elastically supporting the insert in 300 in a backward direction; and a balance weight 400 coupled rotatable to the rear surface of the inertia wheel 100, for supporting the rear end periphery of the insert pin 300, the balance weight 400 rotating with the centrifugal force generated by the rotation of the inertia wheel 100 to push the insert pin 300 forward to allow the insert pin 300 and the power transmitting eccentric body 210 to be engaged with each other, wherein the balance weight 400 is punched at the center portion thereof and has a general shape of "□", "○", or "∩", the balance weight 400 having a rear weight portion 410 formed protruded backward on one side supporting the rear end periphery of the insert pin 300 around a balance pin 430 as a rotary shaft thereof and a front weight Portion 420 formed protruded forward on the other side thereof, wherein the insert pin 300 has a first steel ball accommodating groove 310 formed along the outer peripheral surface thereof, and the inertia wheel 100 comprises: a spring hole 130 formed on the side surface thereof in such a manner as to communicate with the guide hole 110, the spring hole 130 having a screw thread formed on a portion thereof; a steel ball 140 inserted into the spring hole 130 in such a manner as to be brought into contact with the outer periphery of the insert pin 300; a tension spring 150 inserted into the spring hole 130, for elastically supporting the steel ball 140 against one side portion thereof; and a tension adjusting pin 160 fastened to the screw thread formed on the spring hole 130, for supporting the other side end portion of the tension spring 150.

16. A rotational force transmitting device comprising:

an inertia wheel 100 connected to an output gear 22 rotating engagedly with a driving motor 11 and rotating by receiving the rotational force of the driving motor 11;

a spindle 200 coupled freely rotatable to the center of the front surface of the inertia wheel 100;

a power transmitting eccentric body 210 extended vertically with respect to the rotary shaft of the spindle 200 from one side of the spindle 20;

an insert pin 300 inserted into a guide hole 110 formed passed through the front and rear surfaces of the inertia wheel 100;

a position restoring spring 320 inserted into the guide hole 110, for elastically supporting the insert pin 300 in a backward direction; and a balance weight 400 coupled rotatable to the rear surface of the inertia wheel 100, for supporting the rear end periphery of the insert pin 300, the balance weight 400 rotating with the centrifugal force generated by the rotation of the inertia wheel 100 to push the insert pin 300 forward to allow the insert in 300 and the power transmitting eccentric body 210 to be engaged with each other, wherein the insert pin 300 has a first steel ball accommodating groove 310 and a second steel ball accommodating groove 310 formed spaced apart from each other by a given distance along the outer peripheral surface thereof, and the inertia wheel 100 comprises: a spring hole 130 formed on the side surface thereof in such a manner as to communicate with the guide hole 110, the spring hole 130 having a screw thread formed on a portion thereof; a steel ball 140 inserted into the spring hole 130 in such a manner as to be brought into contact with the outer periphery of the insert pin 300; a tension spring 150 inserted into the spring hole 130, for elastically supporting the steel ball 140 against one side portion thereof; and a tension adjusting pin 160 fastened to the screw thread formed on the spring hole 130, for supporting the other side end portion of the tension spring 150, whereby the steel ball 140 is engaged with the first steel ball accommodating groove 310 of the insert pin 300 when the insert pin 300 pushes backward, and if the insert pin 300 pushes forward by means of the centrifugal force of the balance weight 400 to allow the insert pin 300 to be engaged with the concave groove 211 of the power transmitting eccentric body 210, the steel ball 140 is engaged with the second steel ball accommodating groove 315.

17. A rotational force transmitting device comprising:

an inertia wheel 100 connected to an output gear 22 rotating engagedly with a driving motor 11 and rotating by receiving the rotational force of the driving motor 11;

a spindle 200 coupled freely rotatable to the center of the front surface of the inertia wheel 100;

a power transmitting eccentric body 210 extended vertically with respect to the rotary shaft of the spindle 200 from one side of the spindle 20;

an insert pin 300 inserted into a guide hole 110 formed passed through the front and rear surfaces of the inertia wheel 100;

a position restoring spring 320 inserted into the guide hole 110, for elastically supporting the insert in 300 in a backward direction; and a balance weight 400 coupled rotatable to the rear surface of the inertia wheel 100, for supporting the rear end periphery of the insert pin 300, the balance weight 400 rotating with the centrifugal force generated by the rotation of the inertia wheel 100 to push the insert pin 300 forward to allow the insert pin 300 and the power transmitting eccentric body 210 to be engaged with each other, further comprising:

bearings 230 fitted to the spindle 200 coupled to the center of the front surface of the inertia wheel 100; and a circular plate spring 220 fitted to the spindle 200 together with the bearings 230, for absorbing the vibration generated forward and backward.

18. A rotational force transmitting device comprising:

an inertia wheel 100 connected to an output gear 22 rotating engagedly with a driving motor 11 and rotating by receiving the rotational force of the driving motor 11;

a spindle 200 coupled freely rotatable to the center of the front surface of the inertia wheel 100;

a power transmitting eccentric body 210 extended vertically with respect to the rotary shaft of the spindle 200 from one side of the spindle 20;

an insert pin 300 inserted into a guide hole 110 formed passed through the front and rear surfaces of the inertia wheel 100;

a position restoring spring 320 inserted into the guide hole 110, for elastically supporting the insert pin 300 in a backward direction; and a balance weight 400 coupled rotatable to the rear surface of the inertia wheel 100, for supporting the rear end periphery of the insert pin 300, the balance weight 400 rotating with the centrifugal force generated by the rotation of the inertia wheel 100 to push the insert pin 300 forward to allow the insert pin 300 and the power transmitting eccentric body 210 to be engaged with each other, further comprising a rubber pad type shock absorber 600 disposed between the inertia wheel 100 and the output gear 22 to transmit the rotational force of the output gear 22 to the inertia wheel 100 and to absorb the external shock transmitted through the inertia wheel 100, the rubber pad type shock absorber 600 comprising:

a rotary plate 610 having an output gear coupling groove 611 formed on the rear surface thereof and engaged rotatably with the output gear 22 and a rotational force coupling protrusion 612 protruded from the front surface thereof;

a shock absorbing rubber pad 620 engaged rotatably with the rotational force coupling protrusion 612 of the rotary plate 610; and a shock absorbing drum 630 having a rubber pad accommodating portion 631 formed on the rear surface thereof to accommodate the shock absorbing rubber pad 620 thereinto and a first inertia wheel coupling protrusion 632 protruded from the front surface thereof, wherein as the shock absorbing rubber pad 620 rotating engagedly with the rotary plate 610 is open outwardly by means of the centrifugal force, the shock absorbing rubber pad 620 is brought into close contact with the inner peripheral surface of the rubber pad accommodating portion 631, thus transmitting the rotational force of the rotary plate 610 to the shock absorbing drum 630.

19. A rotational force transmitting device comprising:

an inertia wheel 100 connected to an output gear 22 rotating engagedly with a driving motor 11 and rotating by receiving the rotational force of the driving motor 11;

a spindle 200 coupled freely rotatable to the center of the front surface of the inertia wheel 100;

a power transmitting eccentric body 210 extended vertically with respect to the rotary shaft of the spindle 200 from one side of the spindle 20;

an insert pin 300 inserted into a guide hole 110 formed Passed through the front and rear surfaces of the inertia wheel 100;

a position restoring spring 320 inserted into the guide hole 110, for elastically supporting the insert pin 300 in a backward direction; and a balance weight 400 coupled rotatable to the rear surface of the inertia wheel 100, for supporting the rear end periphery of the insert pin 300, the balance weight 400 rotating with the centrifugal force generated by the rotation of the inertia wheel 100 to push the insert pin 300 forward to allow the insert pin 300 and the power transmitting eccentric body 210 to be engaged with each other, further comprising a spring type shock absorber 700 disposed between the inertia wheel 100 and the output gear 22 to transmit the rotational force of the output gear 22 to the inertia wheel 100 and to absorb the external shock transmitted through the inertia wheel 100, the spring type shock absorber 700 comprising:

a shock absorbing spring 710 fitted to the output gear shaft 33 protruded long from the front surface of the output gear 22;

a hitting absorbing body 720 having a spring accommodating portion 721 formed on the rear surface thereof and a second inertia wheel coupling protrusion 722 formed on the front surface thereof in such a manner as to be coupled to the inertia wheel 100; and a fastening bolt 730 fastened to the front end surface of the output gear shaft 33 passed through the interior of the hitting absorbing body 720 to couple the hitting absorbing body 720 and the output gear 22, wherein the shock absorbing spring 710 is fitted to the output gear shaft 33 and compressed inside the hitting absorbing body 720 in such a manner as to elastically support the hitting absorbing body 720, thus transmitting the rotational force of the output gear 22 to the hitting absorbing body 720.

20. The rotational force transmitting device according to claim 19, wherein the spring type shock absorber 700 further comprises:

shock absorbing rubber 740 fitted to the output gear shaft 33 and disposed between the shock absorbing spring 710 and the output gear 22;

a thrust bearing 750 fitted to the output gear shaft 33 and disposed between the inner peripheral surface of the hitting absorbing body 720 and the shock absorbing spring 710; and a fixing cap 760 mounted between the front surface of the hitting absorbing body 720 and the fastening bolt 730.

* * * * *